US011852326B2

(12) United States Patent
Stucchi

(10) Patent No.: US 11,852,326 B2
(45) Date of Patent: Dec. 26, 2023

(54) CONNECTION DEVICE WITH MOBILE COMMAND DEVICE

(71) Applicant: A.A.G. Stucchi S.r.l., Olginate (IT)

(72) Inventor: Aristide Stucchi, Lecco (IT)

(73) Assignee: A.A.G. STUCCHI S.R.L., Olginate (IT)

( * ) Notice: Subject to any disclaimer, the term of this patent is extended or adjusted under 35 U.S.C. 154(b) by 0 days.

(21) Appl. No.: 17/783,824

(22) PCT Filed: Dec. 9, 2020

(86) PCT No.: PCT/IB2020/061700
§ 371 (c)(1),
(2) Date: Jun. 9, 2022

(87) PCT Pub. No.: WO2021/116939
PCT Pub. Date: Jun. 17, 2021

(65) Prior Publication Data

US 2023/0010369 A1 Jan. 12, 2023

(30) Foreign Application Priority Data

Dec. 11, 2019 (IT) ..... 102019000023634

(51) Int. Cl.
*F21V 21/35* (2006.01)
*F21V 23/06* (2006.01)
(Continued)

(52) U.S. Cl.
CPC ..... *F21V 21/35* (2013.01); *F21V 23/06* (2013.01); *H01R 13/20* (2013.01); *H01R 13/641* (2013.01)

(58) Field of Classification Search
CPC ..... F21V 21/35; F21V 23/06; H01R 13/20; H01R 13/641; H01R 13/703; H01R 25/142
See application file for complete search history.

(56) References Cited

U.S. PATENT DOCUMENTS 4,029,378 A 6/1977 Bollis
7,563,016 B1 * 7/2009 Mier-Langner ..... F21V 17/107 362/648
(Continued)

FOREIGN PATENT DOCUMENTS

DE 202012004156 U1 7/2012
EP 0033769 A2 8/1981
(Continued)

OTHER PUBLICATIONS

EP 0033769, Aug. 19, 2018, Guido Erdmann, English Translation (Year: 1981).*
(Continued)

*Primary Examiner* — Peggy A Neils
(74) *Attorney, Agent, or Firm* — Florek & Endres PLLC

(57) ABSTRACT

The connection device (100) is for an electrified guide (200) lighting system; the electrified guide (200) provides one longitudinal groove (210) and the connection device (100) is adapted to be inserted into the electrified guide (200); the device comprises a mobile command device (150, 160) and at least a mechanical element (22, 145, 147) and/or at least an electrical contact (148); an actuation of said mobile command device (150, 160) causes the exit of said at least a mechanical element (22, 145, 147) and/or of at least one electrical contact (148) from a side of a casing (130) of the connection device (100); the mobile command device comprises a sliding slider (150) and preferably a plate (152) with one or more slotted holes (153).

15 Claims, 14 Drawing Sheets

(51) Int. Cl.
*H01R 13/20* (2006.01)
*H01R 13/641* (2006.01)

(56) References Cited

U.S. PATENT DOCUMENTS

| | | | | |
|---|---|---|---|---|
| 7,648,263 | B2 * | 1/2010 | Bartlett | H01R 25/142 362/147 |
| 2017/0130915 | A1 * | 5/2017 | Xu | F21V 23/004 |

FOREIGN PATENT DOCUMENTS

| | | | |
|---|---|---|---|
| EP | 3128223 | A1 | 2/2017 |
| FR | 1520959 | A | 4/1968 |

OTHER PUBLICATIONS

Bidet, Sébastien, "International Search Report and Written Opinion of the International Searching Authority for PCT Application No. PCT/IB2020/061700," European Patent Office, Rijswijk, Netherlands, Mar. 19, 2021.

* cited by examiner

CONNECTION DEVICE WITH MOBILE COMMAND DEVICE

FIELD OF THE INVENTION

The present invention relates to a connection device for an electrified guide lighting system.

STATE OF THE ART

Electrified guides have been used for many years in the lighting sector. As known, an electrified guide has a longitudinal groove wherein a connection device, often called "adapter", is inserted. The electrified guide comprises electrical conductors extending in a longitudinal direction and that are placed at the groove surface.

The connection device comprises electrical contacts on its external surface. In use, the electrical contacts of the connection device are in contact with the guide electrical conductors.

In some types of devices, contacts may be extracted/retracted such to exit/enter from/to a casing of the connection device.

In some types of devices, mechanical elements are provided that are adapted to exit/enter from/into a casing of the connection device. Such mechanical elements can be for fixing mechanically the connection device to the electrified guide or to ensure a proper insertion of the connection device into the electrified guide.

There exist several solutions to manually cause (acting directly by means of fingers or of a tool) such exit/entrance.

The general object of the present invention is to provide a connection device with a solution for such exit/entrance that is different from and better than the existing ones.

SUMMARY

This general object as well as other specific objects are reached by the connection device having the characteristics of the appended claims which are to be considered as an integral part of the present disclosure.

It is also an object of the present invention a lighting device comprising such a connection device.

LIST OF FIGURES

Figure 2:
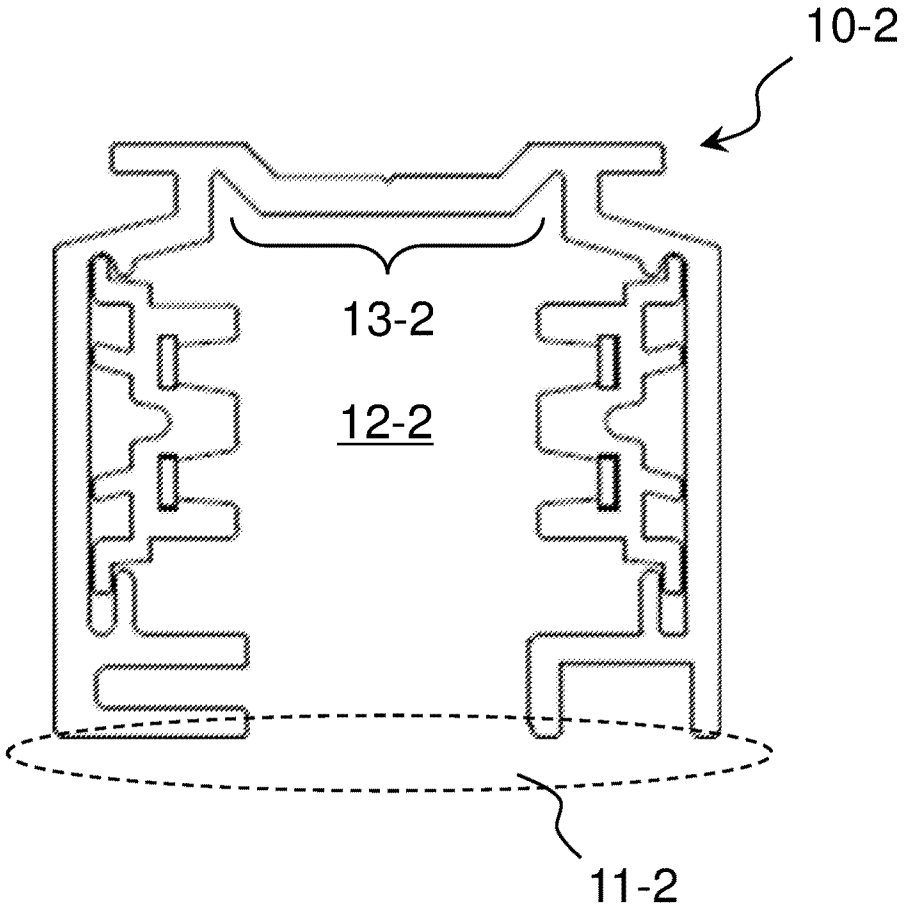
Figure 1:
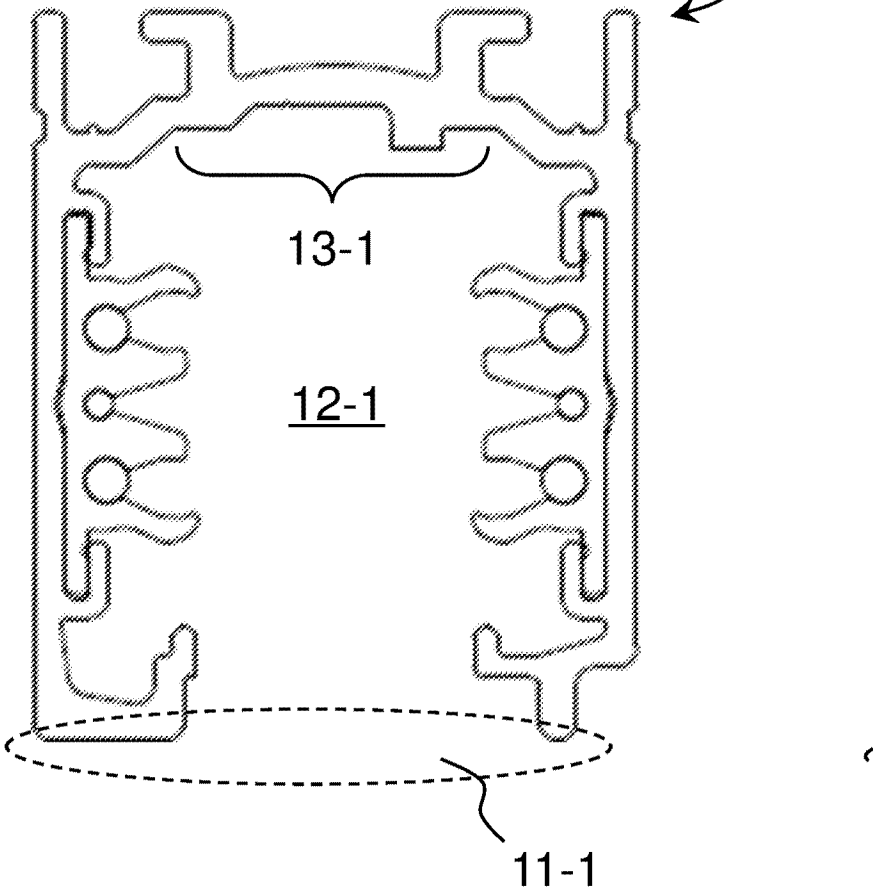
Figure 4:
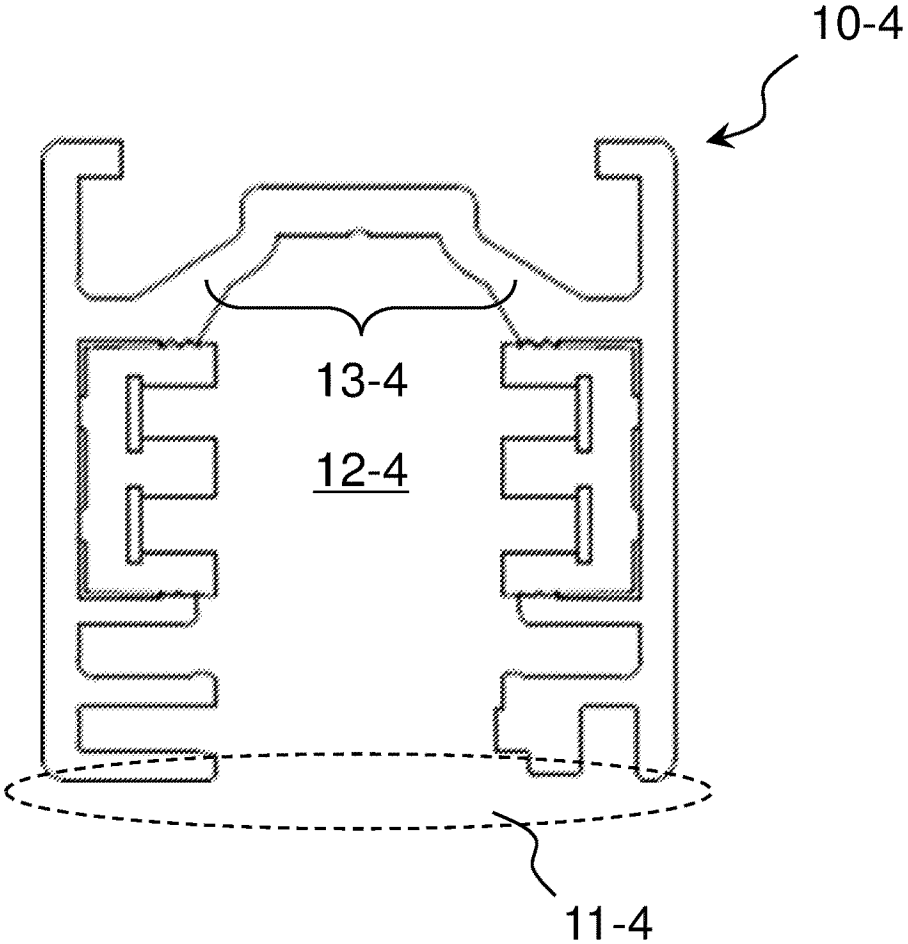
Figure 3:
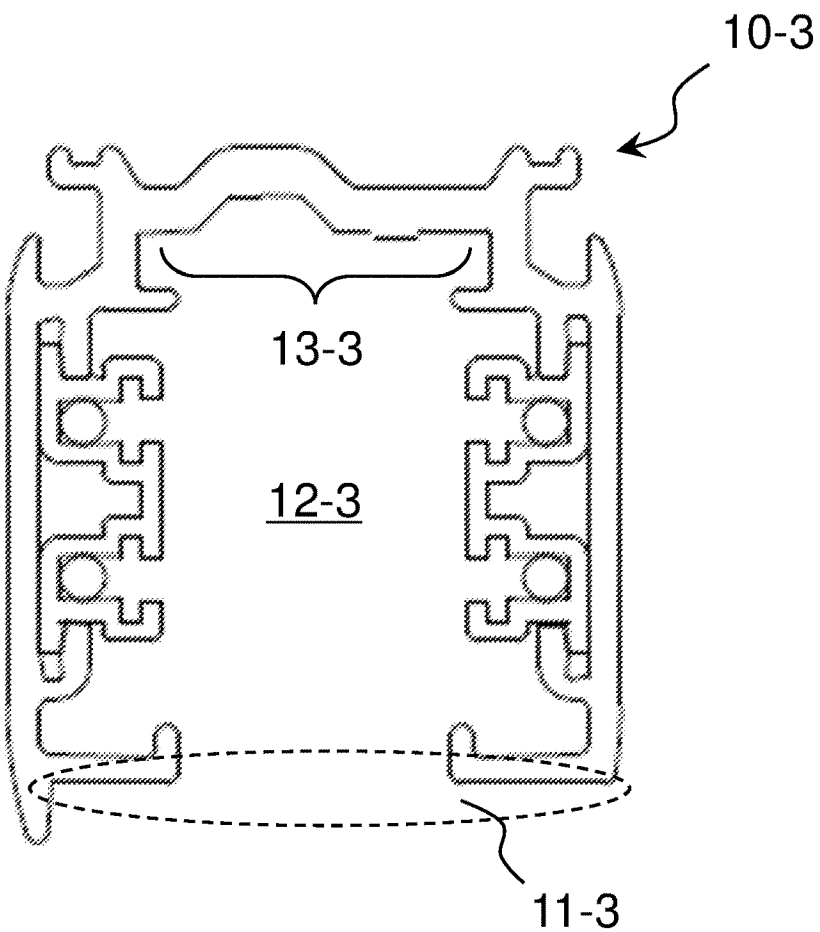
Figure 6:
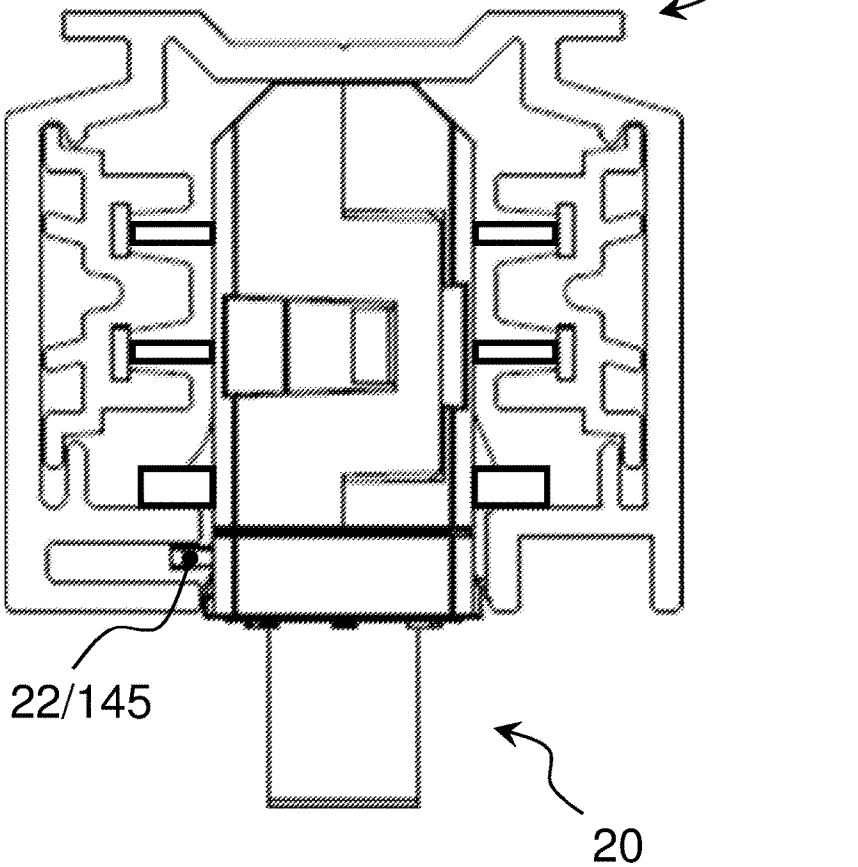
Figure 5:
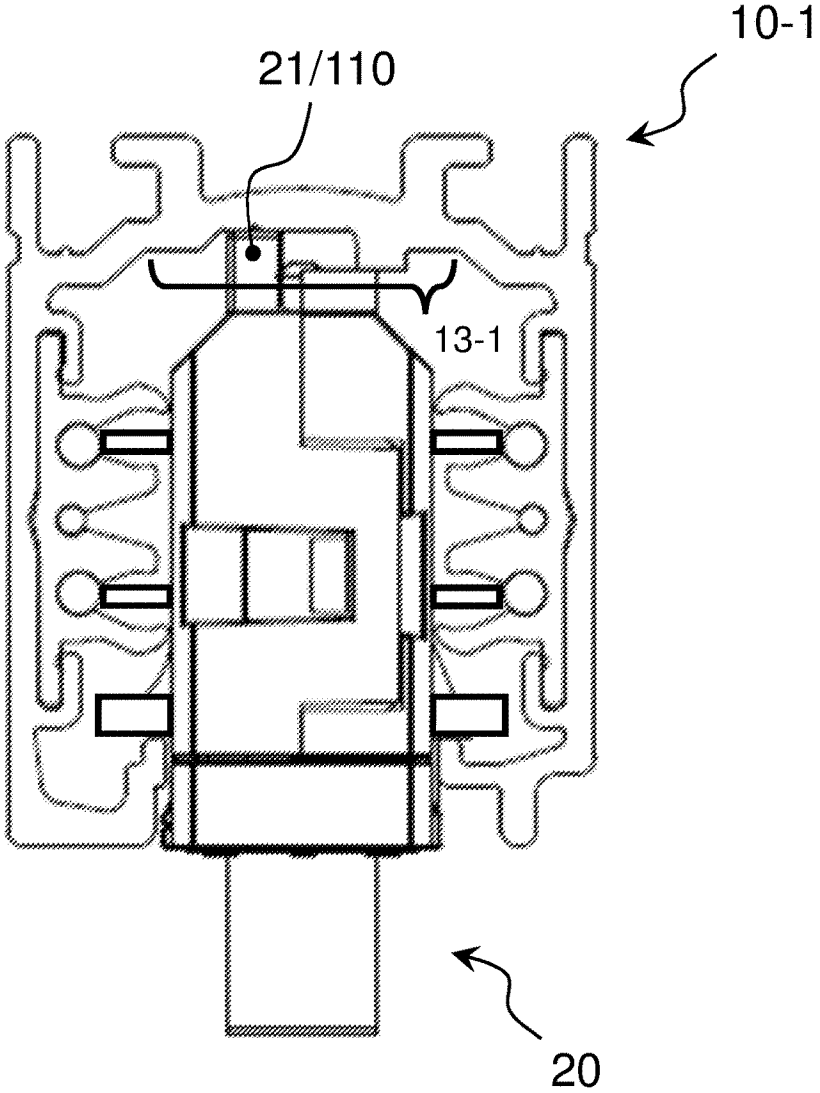
Figure 8:
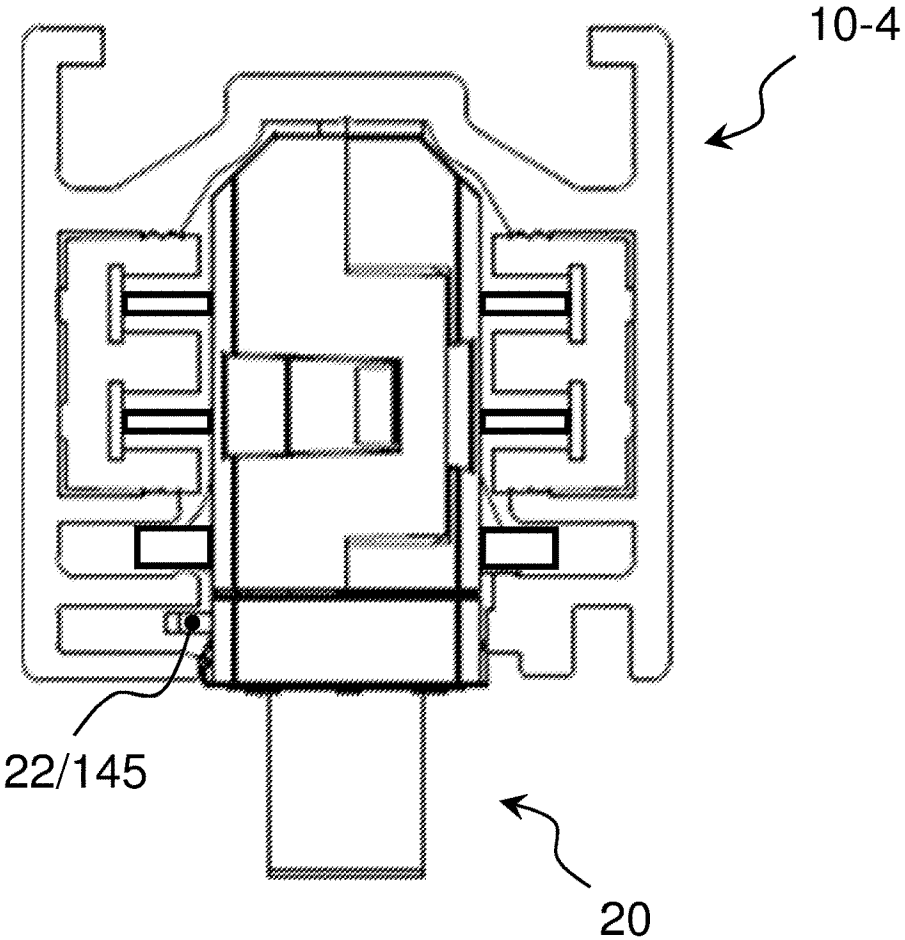
Figure 7:
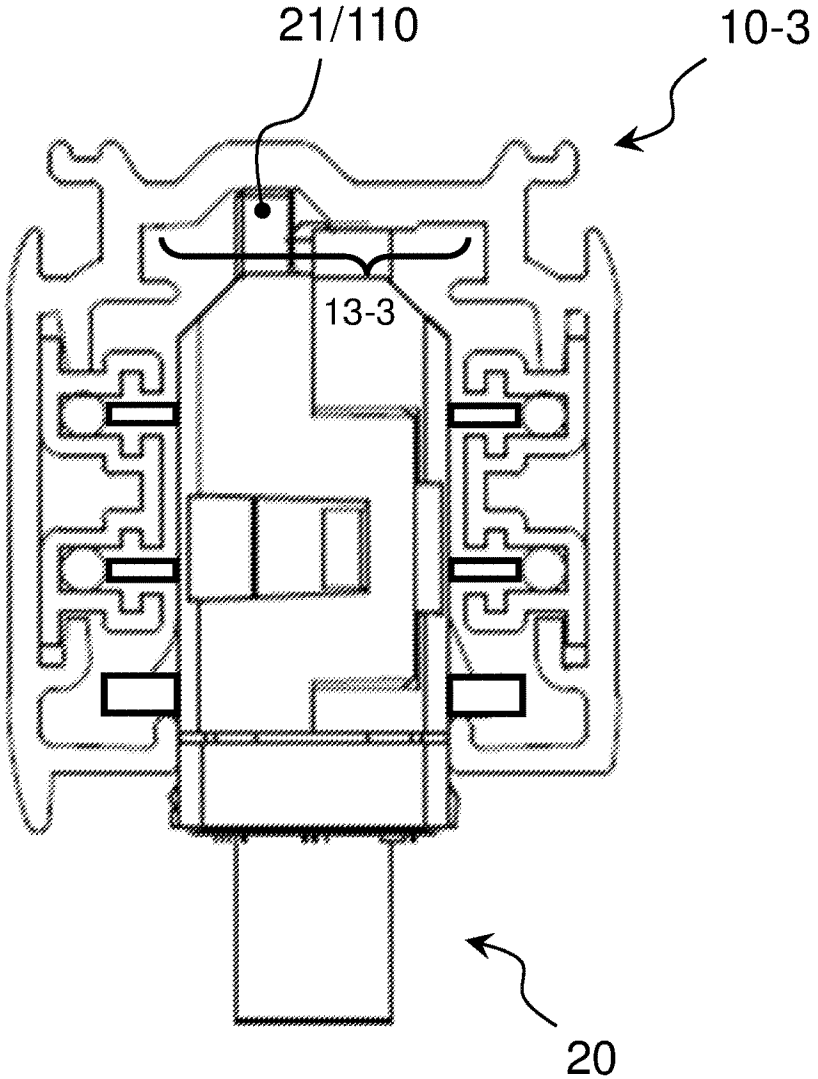
Figure 10:
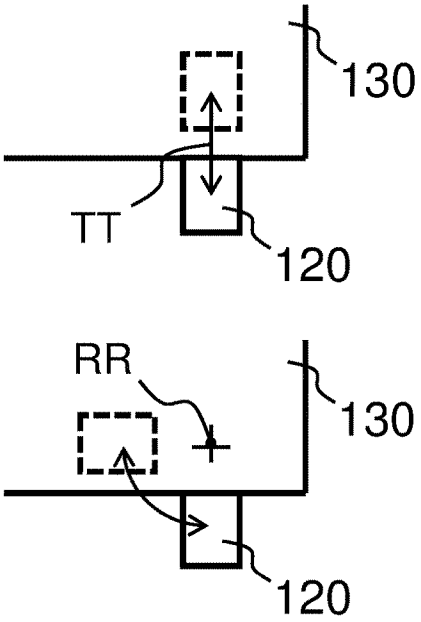
Figure 9:
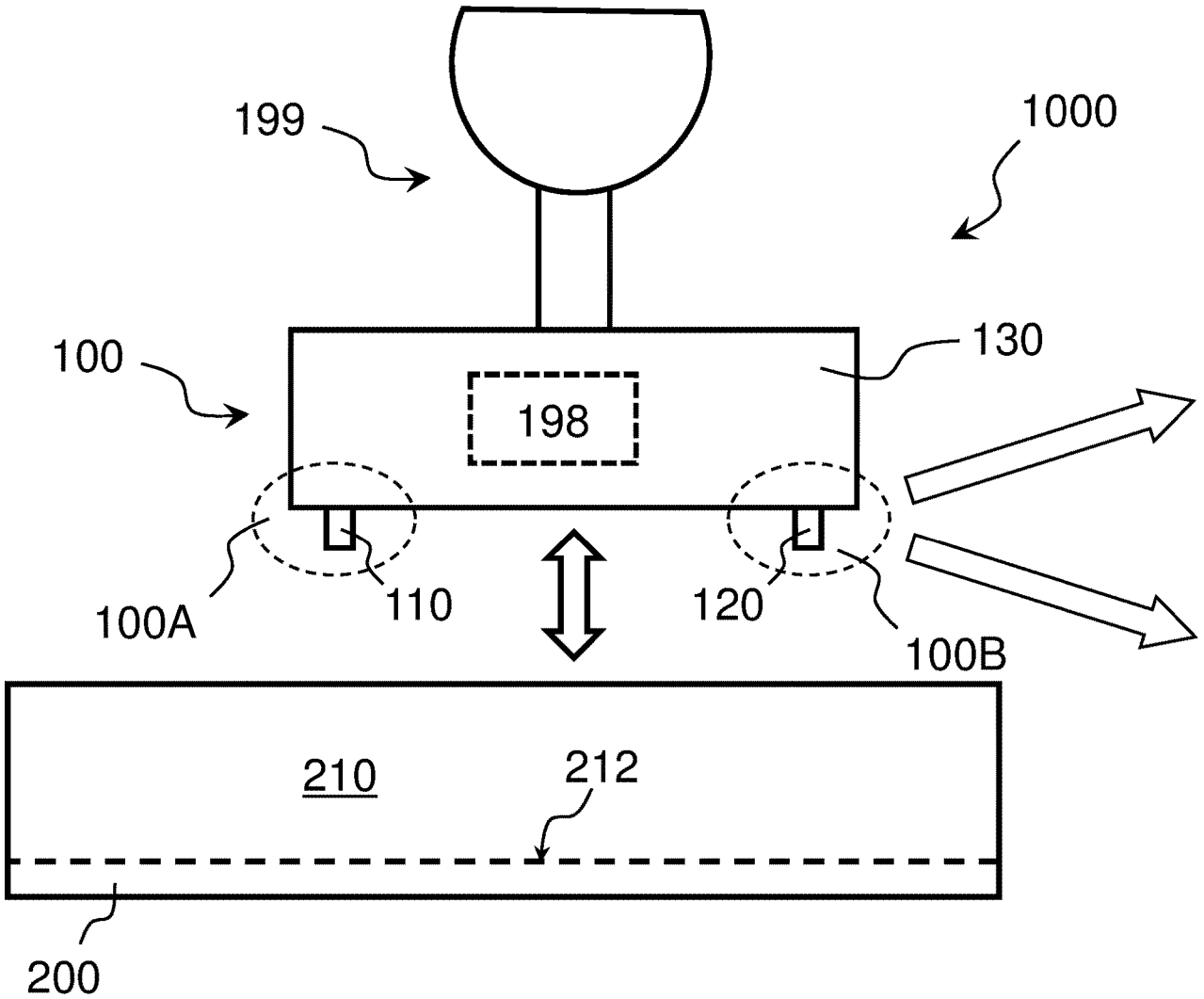

The present invention shall become more readily apparent from the detailed description that follows to be considered together with the accompanying drawings in which:

FIG. 1 shows a section schematic view of one first electrified guide wherein an embodiment of a connection device according to the present invention may be inserted, FIG. 2 shows a section schematic view of one second electrified guide wherein an embodiment of a connection device according to the present invention may be inserted, FIG. 3 shows a section schematic view of one third electrified guide wherein an embodiment of a connection device according to the present invention may be inserted, FIG. 4 shows a section schematic view of one fourth electrified guide wherein an embodiment of a connection device according to the present invention may be inserted, FIG. 5 shows a section schematic view of the electrified guide of FIG. 1 wherein a connection device according to the present invention is inserted, FIG. 6 shows a section schematic view of the electrified guide of FIG. 2 wherein a connection apparatus according to the present invention is inserted, FIG. 7 shows a section schematic view of the electrified guide of FIG. 3 wherein a connection device according to the present invention is inserted, FIG. 8 shows a section schematic view of the electrified guide of FIG. 4 wherein a connection device according to the present invention is inserted, FIG. 9 shows one first highly schematic and laterally partial view of a lighting device (with connection device) according to the present invention and of one electrified guide, FIG. 10 shows two possible different and alternative movement schemes of a mechanical contact device of the connection device of FIG. 9.

Figure 11:
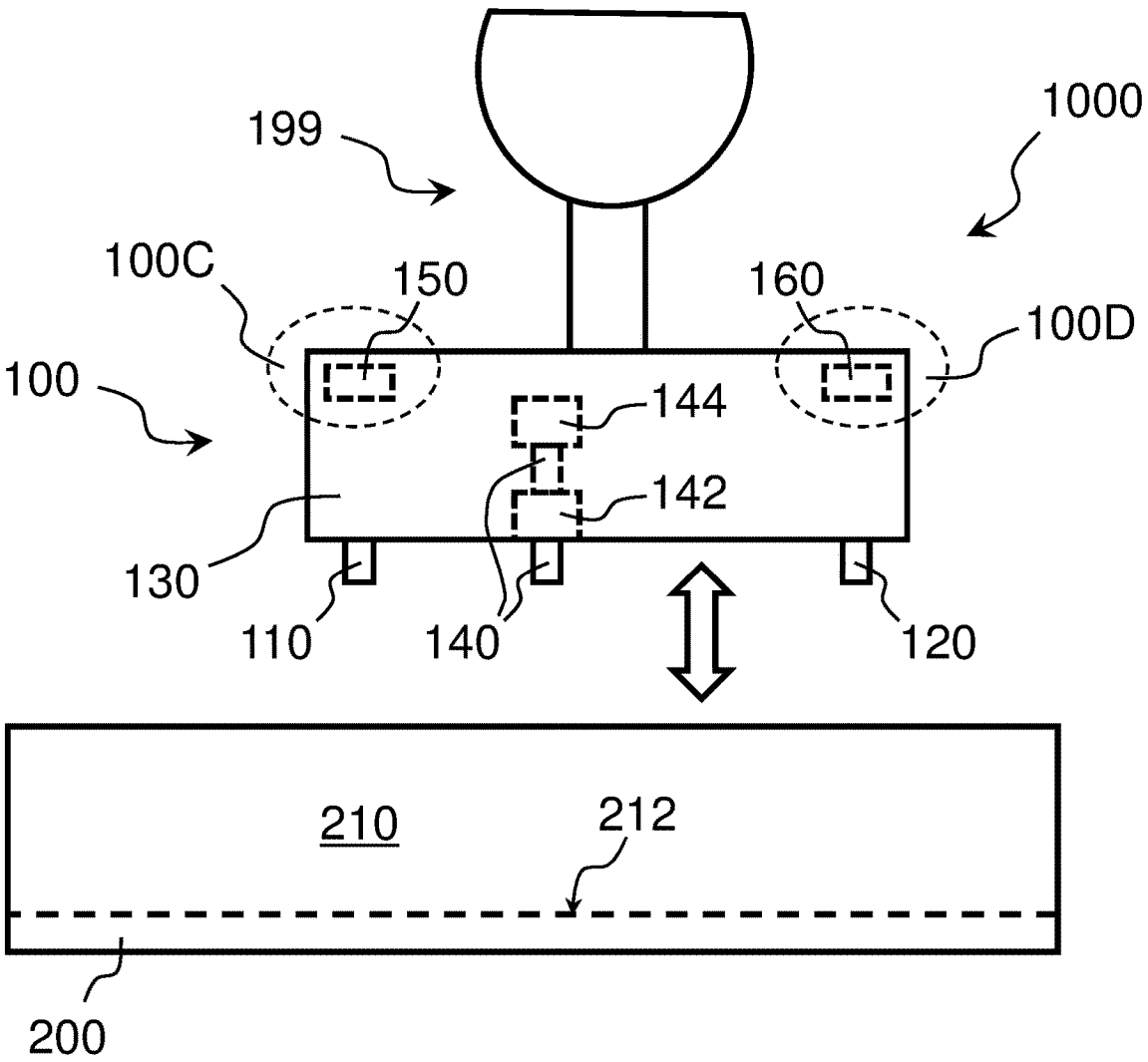
Figure 12A:
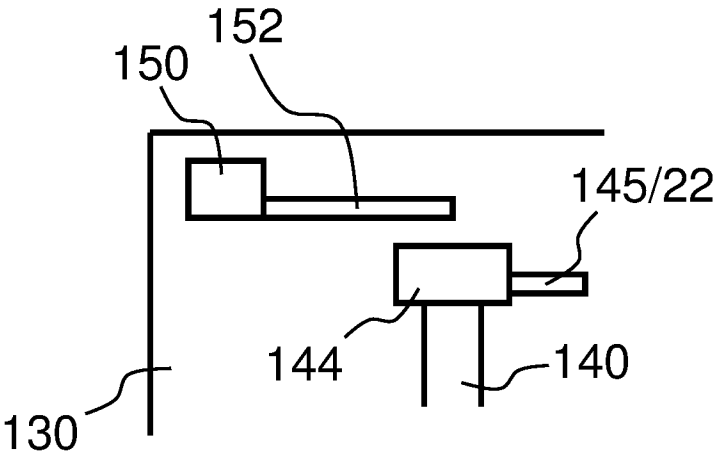
Figure 12B:
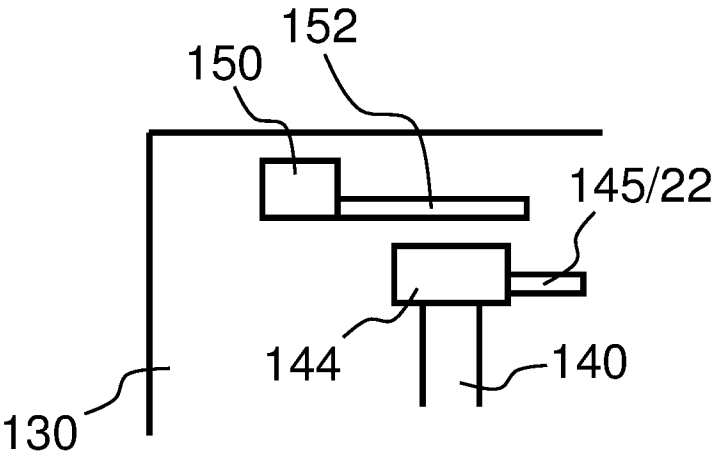
Figure 12C:
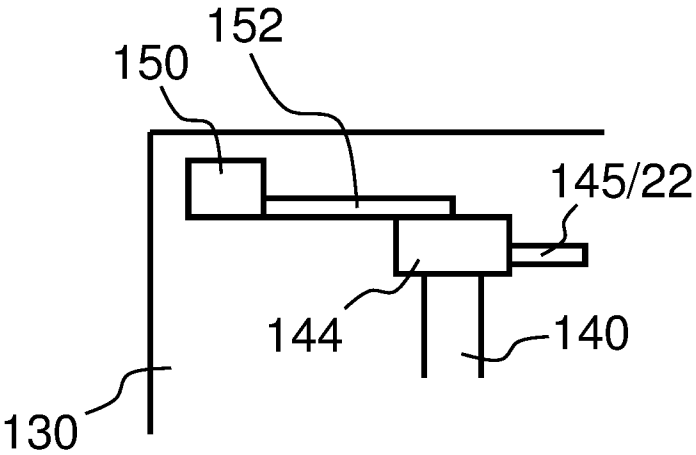
Figure 12D:
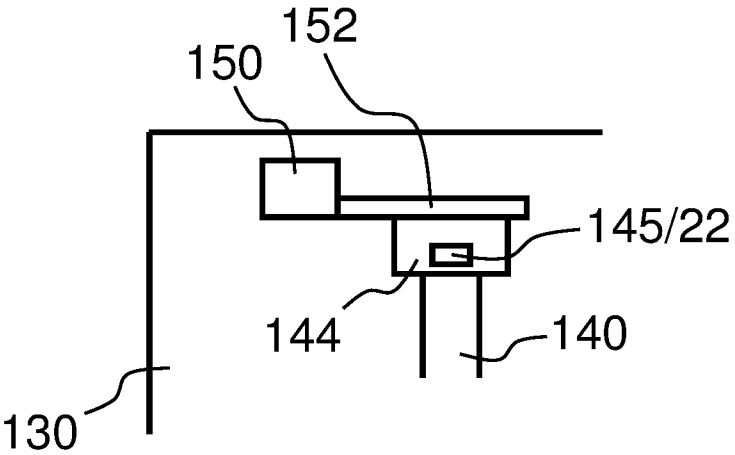
Figure 13:
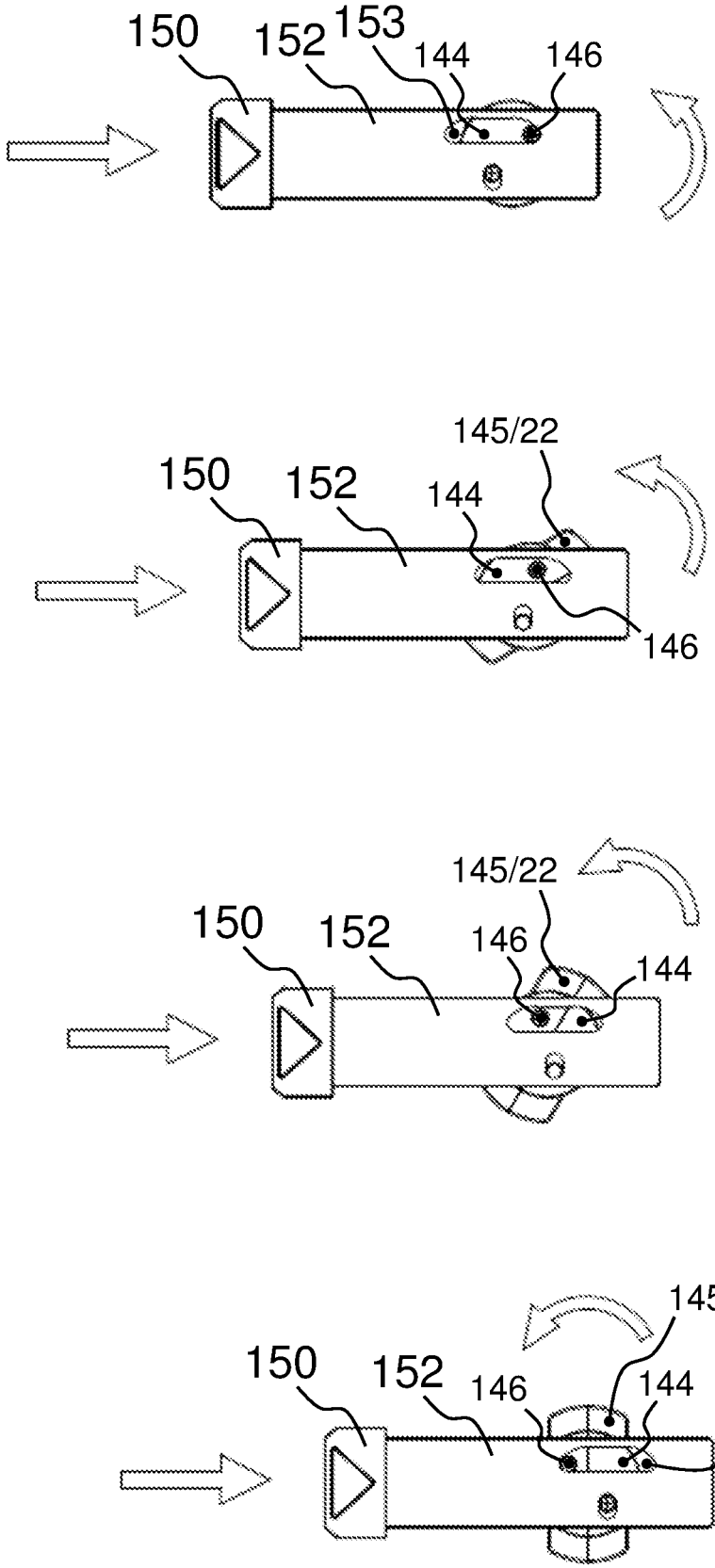
Figure 14:
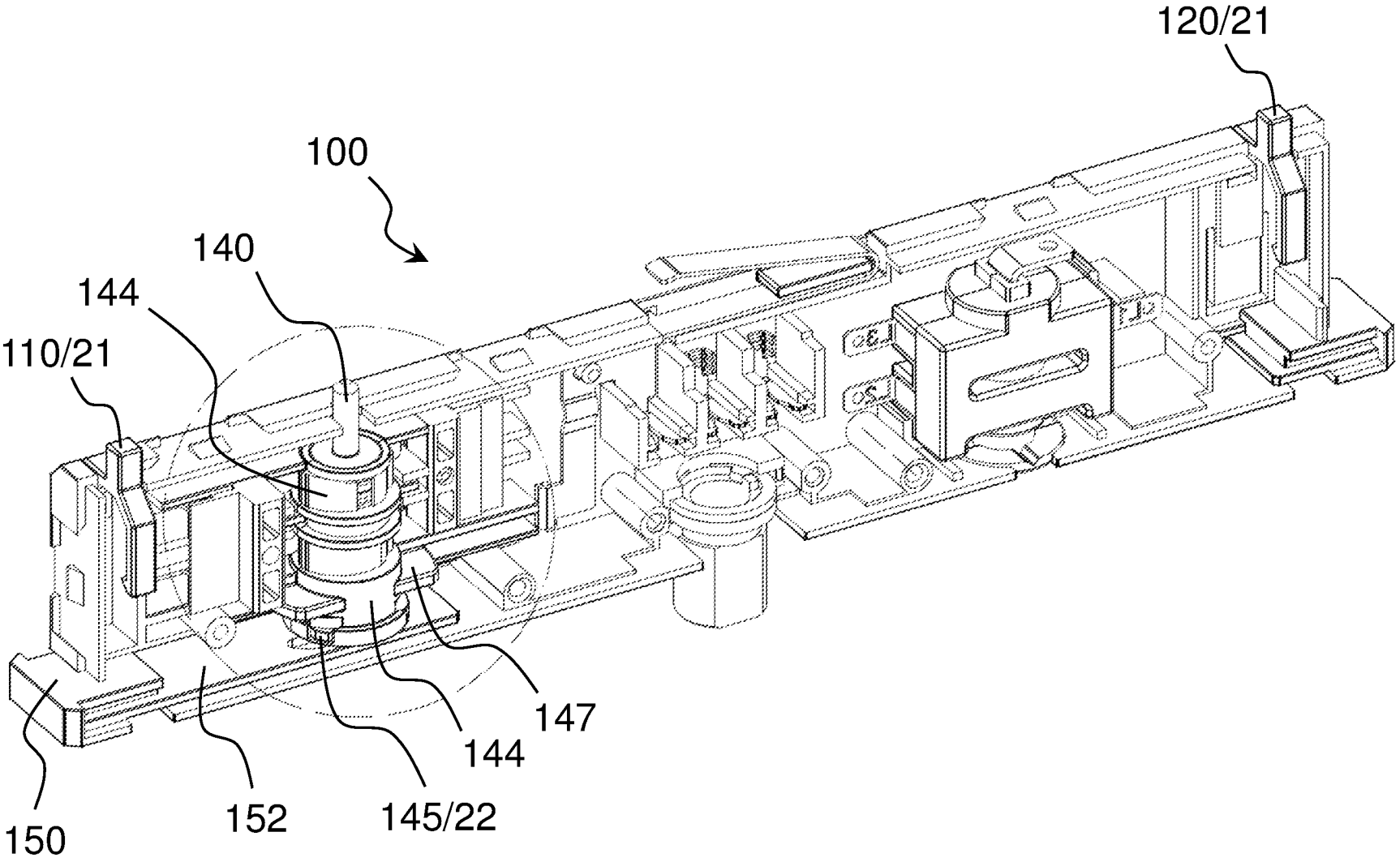
Figure 15B:
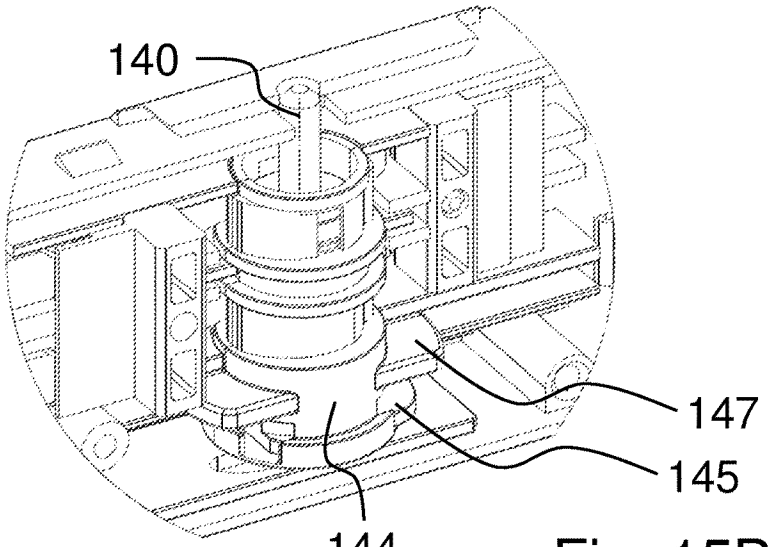
Figure 15D:
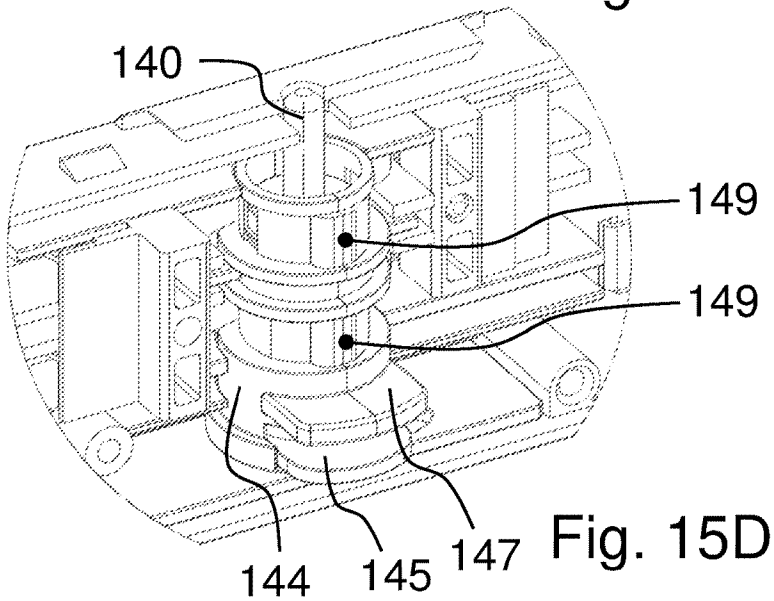
Figure 15A:
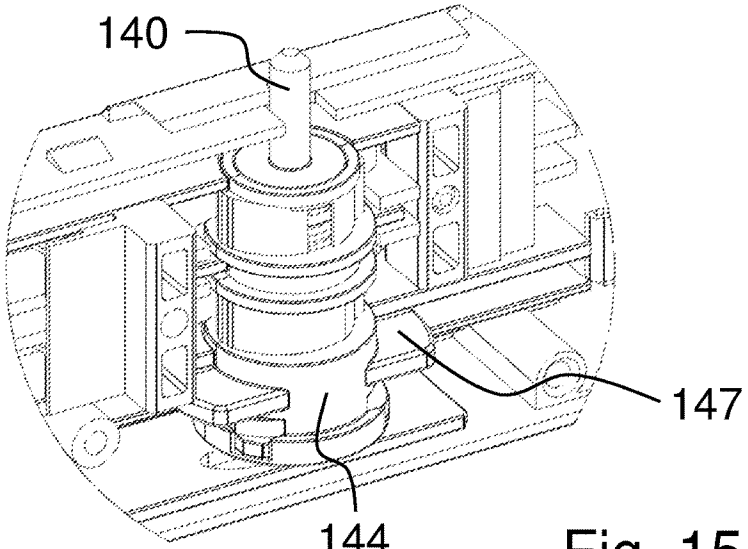
Figure 15C:
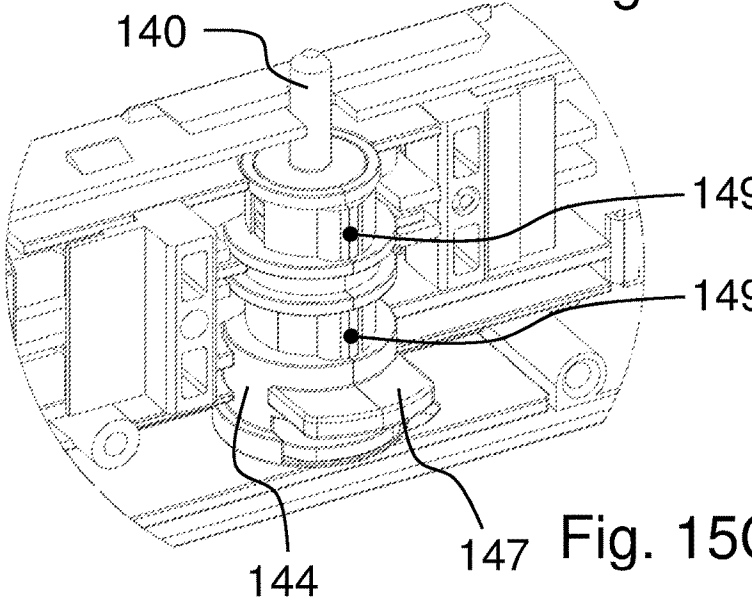
Figure 16:
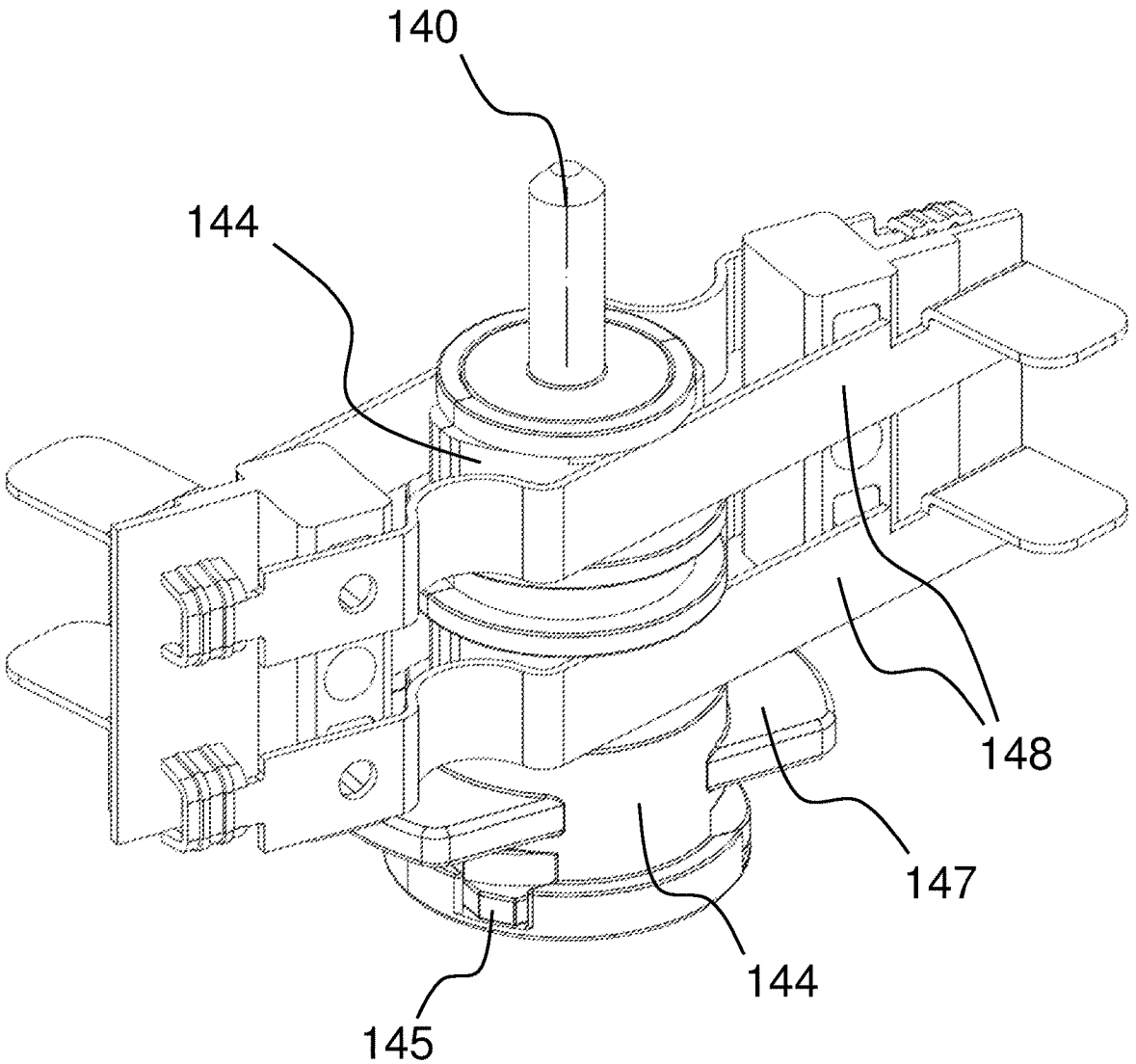
Figure 17:
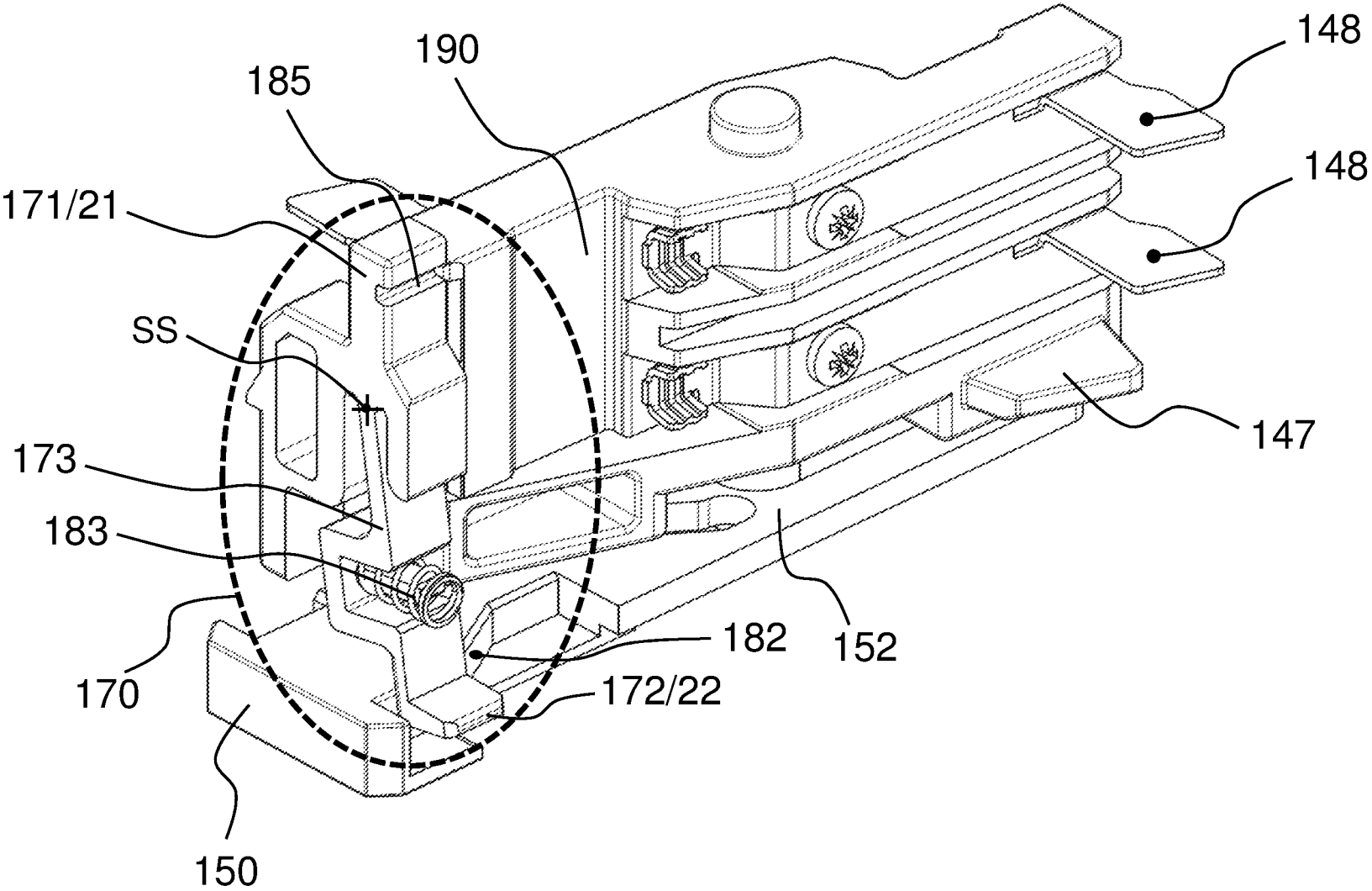

FIG. 11 shows one second highly schematic and laterally partial view of a lighting device (with connection device) according to the present invention and of one electrified guide, FIG. 12 shows schematically four different configurations of the connection device of FIG. 9 and FIG. 11 adapted to explain an example of a combined operation of a command device and a pin of the device, FIG. 13 shows schematically three different configurations of the connection device of FIG. 9 and FIG. 11 adapted to explain an example of a combined operation of a slider of the device, FIG. 14 shows a section view of one first embodiment of the connection device according to the present invention, FIG. 15 partially shows four different configurations of the connection device of FIG. 14, FIG. 16 shows electrical contacts of the connection device of FIG. 14, FIG. 17 shows a partial view of one second embodiment of the connection device according to the present invention, FIG. 18 shows an example of a combined operation of a command device and a mechanical contact device of the device of FIG. 17, and FIG. 19 shows two different configurations of the mechanical contact of the connection device of FIG. 17.

As can be easily understood, there are various ways of practically implementing the present invention which is defined in its main advantageous aspects in the appended claims and is not limited either to the following detailed description or to the appended drawings.

The expression "adapted to abut" will be hereinafter used in relation to some components of embodiments; it must be specified that such expression does not mean that a component must in any case abut but simply that in at least one or more operative conditions, it abuts.

DETAILED DESCRIPTION

The connection device (for instance the one referred to as 20 or 100 in the figures) according to the present invention is for an electrified guide lighting system (for instance the one referred to as 10 or 200 in the figures); in particular it deals with guides for three-phase power supply.

With non-limiting reference to the FIGS. 9-11, the electrified guide 200 provides a longitudinal groove 210 and the connection device 100 is adapted to be completely inserted into the electrified guide 200, in particular in the longitudinal groove 210 of the electrified guide 200.

According to embodiments of the present invention other than those of FIGS. 9-11, the insertion may be complete; for instance, a 1-5 mm protrusion may be present on a sidewall or on both sidewalls of the guide.

In FIG. 5 and FIG. 6 and FIG. 8, the connection device can be considered as completely inserted in the longitudinal groove of the electrified guide; in FIG. 7, it is considered that there is no protrusion on the left sidewall and that there is a slight protrusion on the right sidewall. At the bottom of all these figures, a rectangular element can be seen which sensibly protrude from the groove, but which is not part of the connection device; in particular it is a support stem of a lighting body similar to the stem shown in FIG. 9 and FIG. 11.

The connection device 100 comprises at least a mechanical contact device adapted to abut against a bottom surface of said longitudinal groove when the connection device is completely (or possibly quite completely) inserted into the electrified guide (see the arrow in FIG. 9 which corresponds to the preferred direction for inserting and extracting the device); in the example of FIG. 9, there are two mechanical contact devices 110 and 120, and they are adapted to abut against a bottom surface 212 of the longitudinal groove 210 when the connection device 100 is completely inserted in the electrified guide 200; this is also true for the example of FIG. 11. In FIG. 5, a mechanical contact device 21 can be seen in abutment against a bottom surface 13-1 (specifically in a portion thereof) of the longitudinal groove 12-1 of the guide 10-1 in a "complete insertion" condition of the connection device 20 in the electrified guide 10-1. In FIG. 7, a mechanical contact device 21 can be seen in abutment against a bottom surface 13-3 (specifically in a portion thereof) of the longitudinal groove 12-3 of the guide 10-3 in a "complete insertion" condition (as previously said, there is a protrusion of the connection device of a few mm on the right sidewall of the guide) of the connection device 20 in the electrified guide 10-3. In FIG. 6 and FIG. 8, there is no abutment between the mechanical contact device and the bottom surface of the longitudinal groove as the device has been removed (or moved), but there is an abutment between the casing of the connection device and the bottom surface of the longitudinal groove.

According to the present invention, the mechanical contact device is removable or (preferably) movable so that the connection device can be adapted to electrified guides having longitudinal grooves with different depths.

By looking at FIG. 1+FIG. 5 and FIG. 3+FIG. 7, it can be noted that the bottom surface of said groove (respectively 13-1 and 13-3) is asymmetrical with respect to the symmetry plane of the guide and that the mechanical contact device is not centered with respect to the symmetry plane of the device. Thereby, in an attempt to insert the device (20) into the guide (respectively 10-1 and 10-3) in a direction opposite to that shown in these figures, it would not be possible to obtain a complete insertion (and consequently electrical connections between the device and the guide) as a mechanical contact would occur when the device is still partially outside the guide. Therefore, the mechanical contact device according to the present invention can be advantageously shaped and/or positioned such to abut (against a bottom surface of said longitudinal groove) in a different way depending on the insertion sense/side of the connection device in the electrified guide so as to prevent being inserted in the wrong sense/side.

FIG. 5 to FIG. 8 schematically show the case of a removable mechanical contact device. While installing the connection device, the operator determines the groove depth of the guide and mounts/removes one or more mechanical contact devices on the device (in particular on the casing of the device) depending on the depth. In the simplest case, there are only two possible widths and devices in just one length are thus provided; in general, devices of different lengths may be provided.

According to alternative solutions wherein the mechanical contact device can be moved, in the simplest case there are just two possible positions (typically, one first position wherein the mechanical contact device protrudes from the casing of the connection device and one second position wherein the device does not protrude from the casing); in general, more positions may be provided (typically, a non-protruding position and other positions having different protrusion).

The mechanical contact device (such as those referred to as 110 and 120 in FIG. 9 and FIG. 10) may be engaged (directly or indirectly) to a casing (for instance the casing 130) of the connection device; the device may be engaged to an internal body of the device which is fixed to the device casing, thereby an indirect engagement occurs.

In FIG. 10 two possible different and alternative movement schemes of a mechanical contact device of the connection device of FIG. 9 are shown; they are two kinematic engagements.

At the bottom of FIG. 10, the mechanical contact device 120 is adapted to rotate about a RR axis that is fixed with respect to the casing 130, but only before inserting the device 100 into the guide 200 (during and after the insertion it is fixed); in one first position (for instance vertical) the device 120 protrudes from the casing 130 and into a second position (for instance horizontal—drawn with a dotted line) the device 120 does not protrude from the casing 130.

At the top of FIG. 10, the mechanical contact device 120 is adapted to translate along an axis TT that is fixed with respect to the casing 130, but only before inserting the device 100 into the guide 200 (during and after the insertion it is fixed); in one first position the device 120 protrudes from the casing 130 and in one second position (drawn with a dotted line) the device 120 does not protrude from the casing 130; there may be other positions protruding differently from the casing 130.

It is important that the mechanic contact device (if present) is adapted to be moved with respect to the casing only before inserting the guide into the device (during and after the insertion it is fixed).

The mechanical contact device may be at a central zone or at an end zone of the connection device; terms "central" and "end" refer to the longitudinal direction of the connection device which, in use, corresponds to the longitudinal direction of the guide.

In the example of FIG. 9, there is one first mechanical contact device 110 which is at one first end zone 100A of the connection device 100 (that is also internal referring to the electrified guide after the device is introduced into the guide), and one second mechanical contact device 120 which is at a second end zone 100B of the connection device 100 (that is also internal referring to the electrified guide after the device is introduced into the guide). Such devices may be identical to each other or different, and the above mentioned considerations can be applied to each of them.

In the example of FIG. 9, an electronic circuitry 198 (which is optional) is shown that is adapted to power-supply at least a lighting device, for instance the one referred to as 199, mechanically fixed and electrically connected to the device; the circuitry 198 receives power supply from the electrified guide 200 which the device 100 is connected to and transmits it to the lighting device. If the connection device according to the present invention (and the corresponding electrified guide) were used for applications other than lighting, the electronic circuitry 198 would be adapted to supply one or more non-lighting electrical and/or electronic devices.

One first advantageous aspect of the connection device according to the present invention is a pin that can be retracted and that is adapted to abut against a bottom surface of a longitudinal groove of an electrified guide; such a first aspect is independent from the previously described mechanical contact device, even if a synergy may be provided. In the example of FIG. 11 (note the analogy between FIG. 9 and FIG. 11), there is a pin 140 that is retractable and adapted to abut against a bottom surface 212 of the longitudinal groove 210 of the guide 200.

The complete retraction of such pin (which in FIG. 5 and in FIG. 7 is partially disguised by the mechanical contact device 21 and in FIG. 6 and in FIG. 8 is entirely disguised inside the casing of the connection device) allows the exit of at least a mechanical element (for example and advantageously in form of a rigid tab) from a side of a casing of the connection device; this is shown, for example in FIG. 6 and in FIG. 8, where the mechanical element exited is referred to by reference 22. It can be observed in these figures that the mechanical element 22 is positioned in a seat of the electrified guide (respectively 10-2 and 10-4). It is important to observe that if the device 20 had been inserted into the guide (respectively 10-2 and 10-4) in a direction opposite to the one shown in these figures, the mechanical element 22 would not have been allowed to exit as it would be blocked by a guide wall (respectively 10-2 and 10-4). In FIG. 5 and in FIG. 7, on the contrary, the pin is not retracted and there is not therefore any exit of the mechanical element 22 even when the connection device is completely inserted in the guide (respectively 10-1 and 10-3) regardless of the insertion direction; in these cases, the proper insertion in the guide is reached by the asymmetrical positioning of the mechanical contact device 21.

It must be noted that the pin retraction does not cause the exit of the mechanical element, but it simply makes it possible to exit; this concept is represented in FIG. 11 by the box 144 which will be better shown hereinafter.

It must also be noted that the pin is adapted to retract (i.e. enter totally or partially the casing) while inserting the connection device in the electrified guide and if the guide is little deep, it is adapted to advance (i.e. exit from the casing) while performing the opposite operation; if the guide is very deep, the pin may also not contact the groove bottom of the electrified guide and thus not retract nor advance.

Finally, in a retractable pin-based solution, before being inserted the pin is "completely advanced" i.e. it protrudes in a great amount from the device casing. While inserting it, if the guide is not very deep, the pin will retract and reach its maximum retraction when the device is fixed in the guide; in this case, we might say that the pin is "completely retracted", even if the pin may protrude in a small amount from the device casing. In the example of FIG. 11, the pin retraction is contrasted by a spring, for example by the spring 142.

The connection device according to the present invention may comprise a mobile command device, and the actuation of this device is responsible for the exit of the mechanical element from a side of a casing of the connection device if the pin is completely retracted. In the example of FIG. 11, there are two mobile command devices 150 and 160 which are in particular two sliding sliders each of which is adapted to be manually actuated (acting directly by means of fingers or of a tool) for instance by an operator.

FIG. 12 schematically show four different configurations of the connection device of FIG. 9 and FIG. 11 adapted to explain the combined operation of a command device and a pin of the device; the slider 150 is associated to a rod 152 (for instance plate-shaped, i.e. relatively thin, for example 2-4 m, and relatively large, for instance 10-20 mm) and the internal body 144 is associated to the pin 140 and to a mechanical element 145 (for instance and advantageously in form of a tab) (that corresponds to the mechanical element 22 in FIG. 6 and FIG. 8). In FIG. 12A, the body is mechanically disengaged from the rod 152; thus, a translation of the slider 150 with the corresponding rod 152 does not cause any movement of the body 144, as it can be seen in FIG. 12B. In FIG. 12C, the pin 140 is completely retracted and the body 144 is therefore mechanically coupled to the rod 152; thus, a translation of the slider 150 with the corresponding rod 152 causes a body rotation 144, as it can be seen in FIG. 12D, with the relative mechanical element 145 exiting from a side of the casing of the connection device.

Mechanisms to convert a linear motion (for example the rod motion 152) into a rotation motion (for example the body motion 144) have been known for a long time; the most common one is the "rack" mechanism; thereafter, particular mechanisms adapted for the present invention will be described. Particularly advantageous mechanisms of this type are based on two gears, in particular a linear gear and a curved gear; according to particularly simple implementations, each gear may also have only one or two "teeth" (see for example FIG. 13—this can be considered an extremely simple type of "rack" mechanism).

According to the example of FIG. 12, there are two conditions: one mechanically coupling rod and body and one mechanically uncoupling them.

Alternatively, two conditions may be provided, both mechanically coupling rod and body, though different (as in the example of FIG. 14-16); in both conditions, the rod 152 translation causes the body 144 rotation: the pin 140 retraction allows passing from the first condition to the second condition: the mechanical element 145 is mechanically coupled to the body 144 so as to rotate together with the body 144. If the pin 140 is completely retracted the coupling is such that the mechanical element 145 exits from a side of the casing 130 when the body 144 rotates and if the pin 140 is completely advanced the coupling is such that the mechanical element 145 does not exit from a side of the casing 130 when the body 144 rotates. We might say that the pin 140 retraction causes a different distance of the mechanical element 145 with respect to the body 144 rotation axis and thus protrusion while rotating.

A second advantageous aspect of the connection device according to the present invention is a slider that is adapted to serve as a command device for a mechanism inside the connection device, in particular for the exit of electrical contact and/or mechanical elements from the connection device; such second aspect is conceptually independent from the mechanical contact device previously described and from the pin previously described, even if there may be a synergy.

It must be specified that in the example of FIG. 14 and FIG. 15 and FIG. 16, there is a mechanical element 145 adapted to exit from a side of the casing (depending on the condition of the pin 140 as previously described), there are other two mechanical elements 147 adapted to exit from two opposite sides of the casing (regardless of the pin 140 condition—alternatively their exit may depend on the condition of a retractable pin), and there are electrical contacts 148 adapted to exit from the sides of the casing (regardless of the pin 140 condition—alternatively their exit may depend on the condition of a retractable pin).

The device may then comprise at least a command device placed at an external end zone of the connection device so that is can be accessible to the operator to be manually actuated (acting directly by means of fingers or of a tool).

In the example of FIG. 11, there is a first command device 150 which is at a first end zone 100C of the connection device 100, and a second command device 160 that is at a second end zone 100D of the connection device 100; the term "end" refers to the longitudinal direction of the connection device which, in use, corresponds to the longitudinal direction of the guide. The first zone 100C and the second zone 100D of the connection device 100 are placed one in front of the other so that the two mobile command devices 150 and 160 are accessible by an operator once the device has been inserted into the guide. Such devices may be equal or different; typically, these devices are for causing distinct components of the connection device exit; the translation of one (or more) of these devices my cause movements (in particular rotations) of one or more components inside the connection device; for each of them the above mentioned considerations may be applied.

Referring to the example of FIG. 12 and FIG. 13, the sliding of a slider 150 causes, by means of the rod 152, the exit of electrical contacts (not shown in these two figures, but shown in FIG. 16) at least from a side of the casing 130 of the connection device 100. In particular, a sliding of the slider 150 causes a translation of the rod 152 which causes a rotation of the body 144.

It must be noted that the body 144, which is a body inside the device 100, has been mentioned both in relation to the exit of the mechanical element 145 and in relation to the exit of contacts. There is in fact a possibility to associate to the same internal rotating body both of them, i.e. mechanical elements and contacts (as shown in particular in FIG. 14 and FIG. 15 and FIG. 16). Obviously, there is also the possibility of using distinct rotating bodies inside the device, in particular and for exemplary purposes one first body for at least a mechanical element and one second body for at least an electrical contact. Mechanisms to convert a linear motion (for example the rod motion 152) into a rotation motion (for example the body motion 144) have been known for a long time; the most common one is the "rack" mechanism; hereinafter and with reference to FIG. 13, a particular mechanism adapted for the present invention is disclosed.

In FIG. 13, the rod 152 has a shaped slotted hole 153 and the body 144 is associated to a pin 146 adapted to move into, in particular to slide along, the slotted hole 153 when the body 144 is mechanically coupled with the rod 152. It is thanks to the shape of the slotted hole that a rod translation causes a rotation of the body. Obviously, more than one slotted hole and more than one pin can be provided, as shown in FIG. 13 wherein there is an additional slotted hole and an additional pin.

In the embodiment 100 shown in FIG. 14 and FIG. 15 and FIG. 16, there is only one rotating internal body 144 associated to a mechanical element 145 and two mechanical elements 147 and four electrical contacts 148 as well as a retractable pin 140; there is also an elongated plate 152 associated to a command device 150, which can translate longitudinally (see for example FIG. 13). In the configuration of FIG. 15A, the pin 140 is not retracted and the plate 152 is not translated; the mechanical elements 147 are arranged longitudinally and inside the casing of the device 100; the element 145 is inside the body 144 and cannot therefore be seen. In the configuration of FIG. 15B, the pin 140 is retracted and the plate 152 is not translated; the mechanical elements 147 are arranged longitudinally and inside the casing of the device 100; the element 145 exits from the body 144 in a longitudinal direction but is inside the casing of the device 100. In the configuration of FIG. 15C, the pin 140 is not retracted and the plate 152 is translated; the mechanical elements 147 are arranged transversally (due to a rotation for instance of 90° of the body 144) and their end part exits from the casing of the device 100; the element 145 is inside the body 144 and cannot therefore be seen. In the configuration of FIG. 15D, the pin 140 is retracted and the plate 152 is translated; the contacts 147 are arranged transversally (due to a rotation for instance of 90° of the body 144) and their end part exits from the casing of the device 100; the element 145 is arranged transversally (due to a rotation for instance of 90° of the body 144) and its end part exits from the casing of the device 100.

It must be noted that, in FIG. 14 and in FIG. 15, no electrical contact is shown, even if electrical contacts in the relative connection device 100 are provided; in FIG. 16, electrical contacts 148 of the connection device 100 of FIG. 14 and FIG. 15 are shown (specifically four electrical contacts, two of them directed towards a first sidewall of the device at the front of the device in FIG. 16 and two directed towards a second sidewall of the device at the back in FIG. 16). In FIG. 16, the body 144 and the retractable pin 140 are also visible. Each electrical contact 148 of FIG. 16 is a shaped metallic element that is engaged to a first end (on the left in FIG. 16) and free at a second end (on the right in FIG. 16) that is provided with a tab; in this example, the tab is adapted to exit from the casing and to make the electrical connection with the electrical conductors of the electrified guide. The body 144 has an eccentric element (referred to as 149 in FIG. 15C and in FIG. 15D) for each electrical contact 148 or an eccentric element for each pair of electrical contacts (this alternative is not shown in the figures); after the rotation of the body 144, for instance of 90°, an eccentric element 149 pushes on an electrical contact 148 and causes the exit (specifically the tab exit) from a side of the casing 130 of the connection device 100.

In the connection device 100 of FIG. 14, the slider 150 is at an end and/or front zone of the device 100. The plate 152, that is fixed to the slider 150, is adjacent (or parallel) to a front wall of the casing of the device 100 and it is inside the casing; it is adapted to translate always remaining adjacent (or parallel) and internal.

According to an embodiment different from that of FIG. 14 and FIG. 15, there are two rotating internal bodies (similar to the body 144 in these figures) with rotation axes that are parallel between each other; a mechanical element (as element 145) is associated for instance to the first rotating body (which is preferably associated to a retractable pin, as pin 140) and two electrical contacts (as contacts 148) are associated for instance to the second rotating body (which is not typically associated also to a retractable pin, as pin 140); a translation of an elongated plate (as plate 152) causes a rotation for instance of 90° of both the rotating internal bodies with effects similar to those described in the previous paragraph.

As already said, FIG. 9 and FIG. 11 show an embodiment of a lighting device 1000 according to the present invention. The device 1000 comprises a connection device 100 and at least a lighting device 199 mechanically fixed and electrically collected to the connection device 100; power supply can pass from the electrified guide 200 to the lighting device 199. In these figures, a lighting body (upper element substantially circular-shaped) and a support stem (lower element substantially rectangular-shaped) of the lighting body have been represented, for exemplary purposes. Previously, three technical aspects (removable or movable mechanical contact device, retractable pin and mobile slider) which can be advantageously combined between each other have been described.

According to a first combination example, contact device and pin can be both used to avoid inserting wrongly the connection device into the electrified guides (and thus wrong electrical connections) and the slider can be used to cause the exit of both a mechanical element and of at least an electrical contact that are both mounted on a single rotating internal body.

According to a second combination example, contact device and pin can be both used to avoid inserting wrongly the connection device into the electrified guides (and thus wrong electrical connections) and the slider can be used to cause the exit of both a mechanical element and of at least an electrical contact that are both mounted on a first and a second rotating internal body.

According to a further embodiment shown in FIG. 17-19, a mechanical contact device adapted to abut against a bottom surface (in particular of a longitudinal groove) of an electrified guide and a mechanical element adapted to exit from (in particular a casing of a) connection device are advantageously integrated in a single device that will be hereinafter called "integrated device" and referred to as a whole as 170 in FIG. 17-19; the integrated device is adapted to be partially contained (in particular mostly) inside the casing of the device.

With reference to FIG. 17, the integrated device 170 is substantially made of a portion 171 adapted to abut against a bottom surface of the electrified guide and a portion 172 adapted to exit from a connection device (in particular transversally, where the term "transversally" refers to the transversal direction of the connection device which, in use, corresponds to the transversal direction of the guide).

In particular, the portion 171 is for instance a prismatic-shaped protrusion and the portion 172 is for instance in form of a rigid tab connected to the body of the integrated device 170 by a rod 173.

Figure 19A:
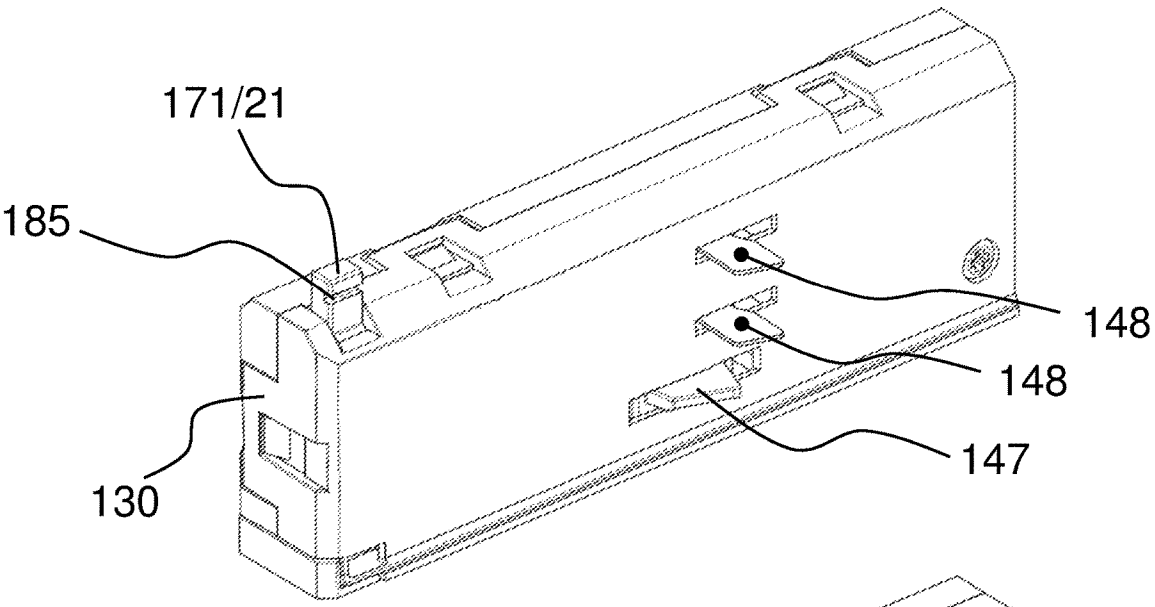
Figure 19B:
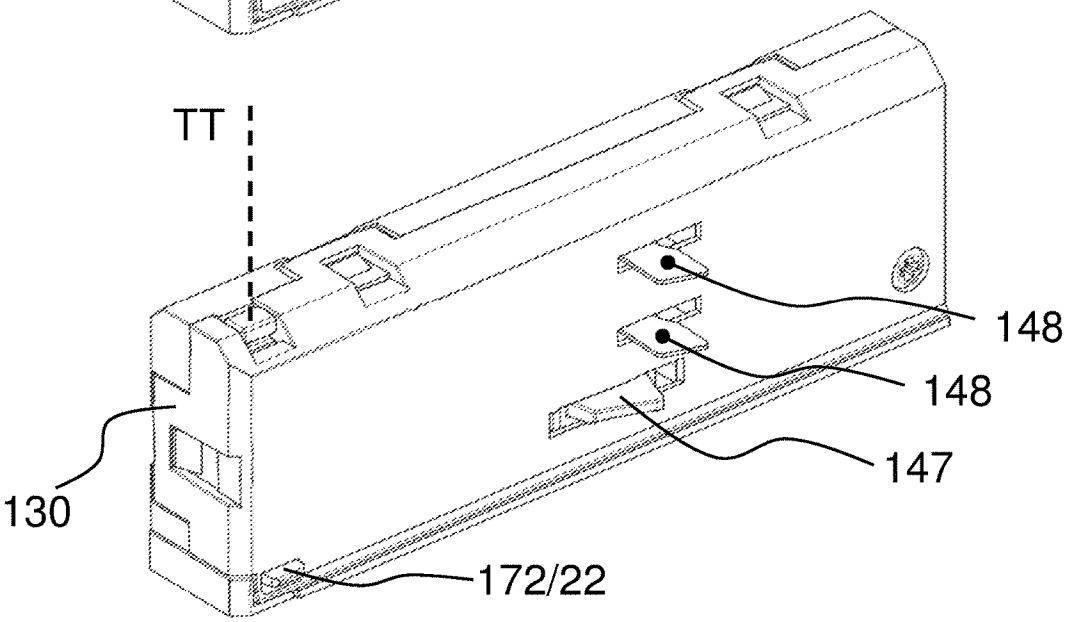

As shown in FIG. 19, the integrated device 170 is adapted to translate along the axis TT (but only before inserting the device 100 into the guide 200—during and after the insertion it is fixed) which is fixed with respect to the casing 130; in one first position shown in FIG. 19A, the integrated device 170, in particular the portion 171, protrudes from the casing 130 and into a second position shown in FIG. 19B, the integrated device 170, in particular the portion 171, does not protrude from the casing 130.

Advantageously and referring to FIGS. 17 and 19, the portion 171 has a groove 185 accessible by an operator from outside the casing 130 of the connection device; in particular the portion 171 can be moved by an operator along the axis TT directly or indirectly acting on such portion, for instance engaging the groove 185 by means of a tool (or directly acting with the fingers) and applying a (pulling) force in one first direction to extract the portion 171 from the casing 130 and (pushing) in one second direction to retract the portion 171 inside the casing 130.

The portion 172 of the integrated device 170 is further adapted to exit from the casing 130 after inserting the device 100 into the guide 200 and due to a mobile command device; in particular, the rod 173 is adapted to rotate about an axis SS (see FIG. 17) that is fixed with respect to the integrated device 170, causing the exit/return of the portion 172 from/to the casing 130 of the connection device (the movement will be hereinafter described in detail).

Advantageously and as shown in FIG. 19, the connection device can comprise at least an integrated device at an end zone of the connection device, where the term "end" refers to the longitudinal direction of the connection device which, in use, corresponds to the longitudinal direction of the guide; it is in particular, the integrated device 170 as of the previous paragraphs.

The connection device according to the present invention may comprise a mobile command device, and the actuation of this device is responsible for the exit of the portion 172 from a side of a casing 130 of the connection device if the portion 171 is completely retracted.

In the example of FIGS. 17 and 18, the mobile command device comprises a sliding slider 150 adapted to be manually actuated (acting directly by means of fingers or of a tool) for instance by an operator; in particular, the slider 150 is associated to a rod 152 of the mobile command device which is, for instance, plate-shaped.

Figure 18A:
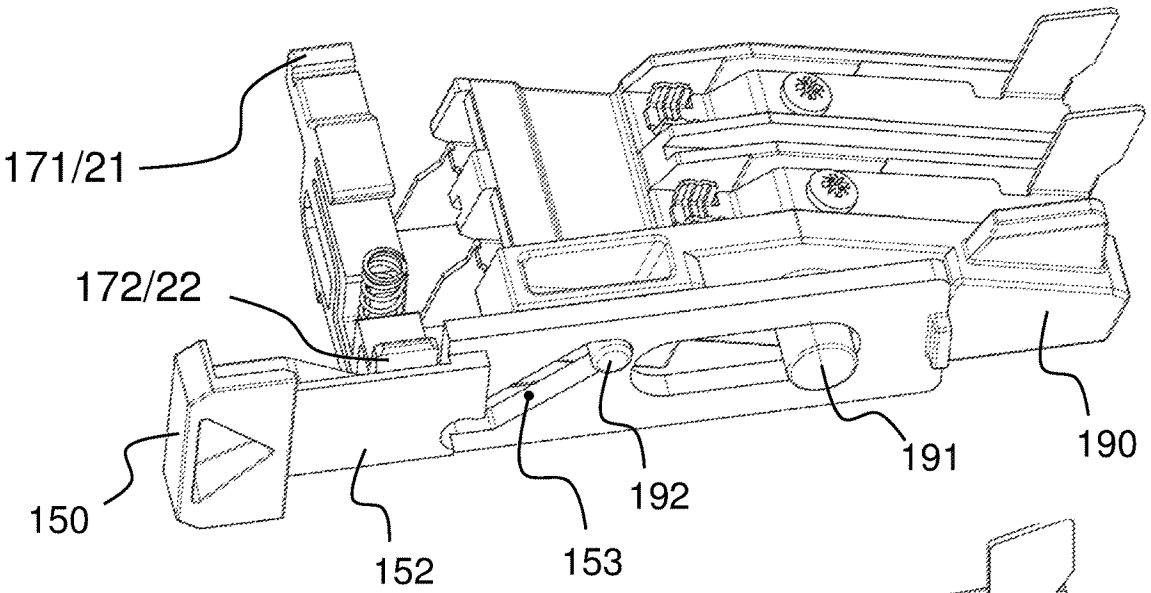
Figure 18B:
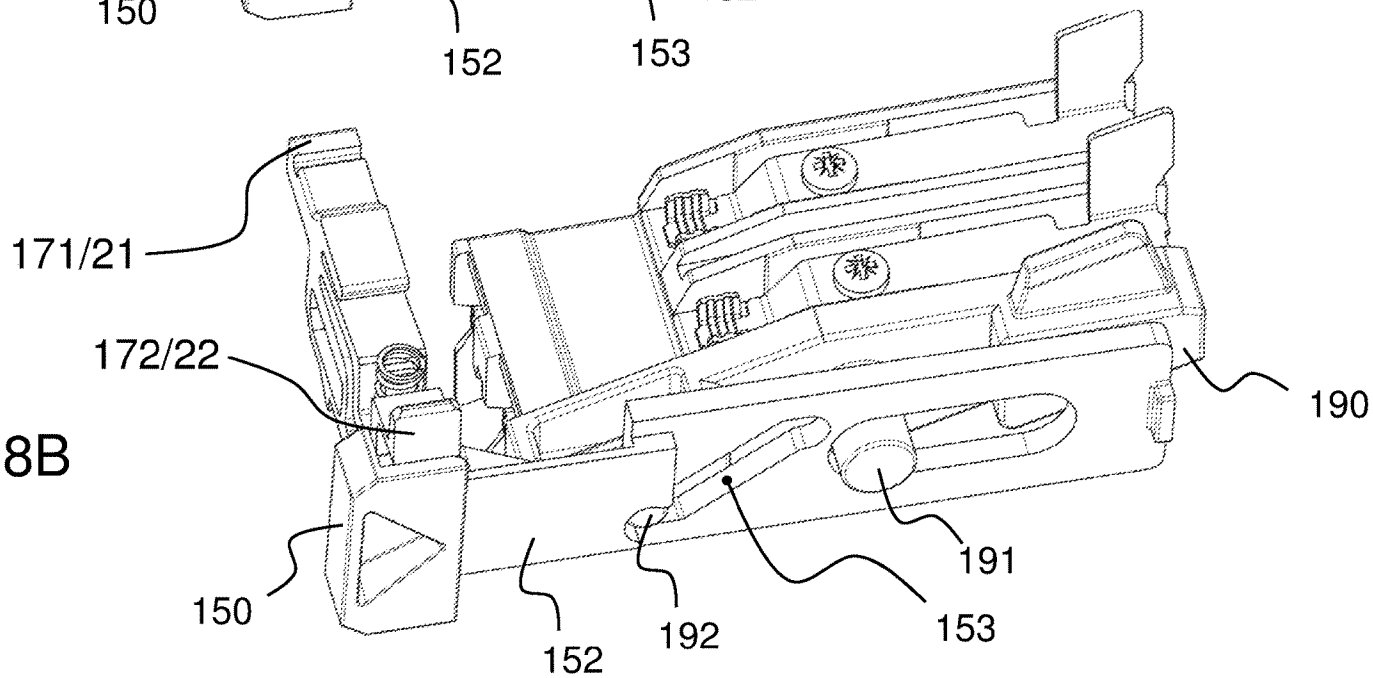

FIGS. 18A and 18B are adapted to explain the combined operation of the mobile command device 150+152 and of the integrated device 170.

It must be noted that there are two conditions of combined operation of the mobile command device 150+152 and of the integrated device 170: a mechanical coupling and a mechanical uncoupling condition. Such conditions are defined by coupling or uncoupling an end zone of the rod 173 (in particular comprising the portion 172) with a recess (in particular a sloped wall 182) of the mobile command device; it must be noted that such recess comprises a sloped wall 182, and, at the two ends thereof, two portions of a wall respectively parallel between each other and to the longitudinal direction, one first portion furthest from an internal surface of the casing 130 and a second portion closest to the internal surface of the casing 130.

In the mechanical coupling conditions, as shown in FIGS. 17 and 18, the portion 171 of the integrated device 170 is in a retracted position i.e. does not exit from the casing of the connection device. In this condition, the end zone of the rod 173 comprising the portion 172 is adapted to be in contact with the walls of the recess of the mobile command device. It must be noted that in this operative condition the casing 130 of the connection device abuts against the bottom surface of the electrified guide when the device is completely or almost completely inserted into the electrified guide.

In particular and as shown in FIG. 18A, the condition wherein the mobile command device is not actuated corresponds to the condition wherein the portion 172 of the integrated device 170 does not exit from the casing 130 and the end zone of the rod 173 is in contact with the wall portion that is furthest from the casing 130. When the mobile command device is actuated (in particular translated from a first position shown in FIG. 18A to a second position shown in FIG. 18B), the end zone of the rod 173 slides along the sloped wall 182 up to reach the wall portion closest to the casing 130 (see FIG. 17 and FIG. 18B). A translation of the mobile command device thus causes a rotation of the rod 173 about the axis SS due to the sliding of the end zone of the rod 173 along the wall portions; in particular, the rotation is caused by the movement of the end zone of the rod 173 passing from a position at the furthest portion to a position at the closest portion; the rotation of the rod 173 causes in turn the portion 172 engaged to the rod 173 to exit laterally from the casing 130 (see FIG. 19B).

In the condition of mechanical uncoupling the end zone of the rod 173 and the recess of the mobile command device, the portion 171 of the integrated device 170 is in an extracted position, i.e. it exits from the casing 130 of the connection device to abut against a bottom surface of the electrified guide; consequently, the entire integrated device 170 is translated along the direction of the axis TT; consequently, the end zone of the rod 173 is not in contact with the recess of the mobile command device, in particular it does not slide thereon. In other words, when the end zone of the rod 173 and the recess of the mobile command device are in the mechanical uncoupling condition, a translation of the mobile command device does not cause the exit of the portion 172 of the integrated device 170.

Advantageously, the integrated device 170 further comprises an elastic element, in particular a spring.

With reference to FIG. 17, the spring 183 exerts a return force on the rod 173 of the integrated device 170; in particular, by the spring 183 the rod 173 is kept in contact with the recess of the mobile command device in case of mechanical coupling as just described. It must be noted that the slider 150 and the rod 152 assembly is further adapted to serve as a mobile command device for a mobile body 190 inside the connection device, shown for example in FIGS. 17 and 18, in particular for the exit of electrical contacts 148 and/or of mechanical elements 147 from the casing 130 of the connection device by the body 190 rotation.

Advantageously the body 190 is associated or comprises two mechanical elements 147, each one adapted to exit from an opposite side of the casing, and/or two pairs of electrical contacts 148, each pair adapted to exit from an opposite side of the casing. It must be noted that the body 190 is commanded by the same mobile command device of the integrated device 170, but the movement of the body 190 is independent from the condition of the integrated device 170.

As shown in FIG. 18, the body 190 comprises a first pin 191 serving as a rotation pin of the body, and a second pin 192 adapted to cooperate with the plate 152; in particular, the plate 152 has a shaped slotted hole 153 wherein the pin 192 is adapted to slide. It is thanks to the shape of the slotted hole 153 that a translation of the mobile command device causes a rotation of the body 190. In particular, the slotted hole 153 comprises a central zone sloped with respect to the longitudinal direction of the connection device, for instance sloped of about 20°, and two end zones parallel to the longitudinal direction of the device, one first end zone that is closest to a first lateral edge of the plate and one second end zone closest to a second lateral edge of the plate.

With reference to FIG. 18A, when the mobile command device is not actuated, the pin 192 is at a first end zone of the slotted hole 153 and electrical contacts 148 and mechanical elements 147 are inside the casing 130.

When the operator actuates (in particular translates) the mobile command device, the pin 192 slides along the sloped central zone making the body 190 perform a rotation movement about the pin 191 axis, up until the pin 192 reaches the second end zone of the slotted hole 153; after the rotation of the body 190 the electrical contacts 148 and the mechanical elements 147 are in an exiting position with respect to the casing 130. Advantageously, the second end zone of the slotted hole 153 comprises an undercut adapted to limit the movement of the pin 192, in particular when the connection device is inserted into the electrical guide and the electrical contacts 148 and/or the mechanical elements 147 are in an exiting position with respect to the casing 130, in particular in contact with one or more portions of the guide. A similar undercut is provided also for the first end zone of the slotted hole 153.

The invention claimed is:

1. A connection device for an electrified guide lighting system;

wherein the electrified guide comprises a longitudinal groove and the connection device is configured to be inserted into the electrified guide;

said connection device comprising a front zone having a first end and a second end, a first command device and a second command device, wherein said first command device is located at the first end of the front zone and said second command device is located at the second end of the front zone, at least one of said first and second command devices comprising a mobile command device, and at least one mechanical element and/or at least one electrical contact;

and wherein actuation of said mobile command device causes the exit of said at least one mechanical element and/or said at least one electrical contact from a side of a casing of the connection device;

wherein the mobile command device comprises a sliding slider.

2. The connection device according to claim 1, comprising a pin that is retractable and configured to abut against a bottom surface of said longitudinal groove, and wherein a retraction of said pin allows the exit of said at least one mechanical element and/or of at least one mechanical contact and/or of at least one electrical contact.

3. The connection device according to claim 1, wherein an actuation of said first and/or second command device causes the rotation of at least one internal body of the connection device.

4. The connection device according to claim 3, wherein said internal body is associated with said at least one mechanical element and/or at least one mechanical contact and/or at least one electrical contact so that they rotate together with said internal body.

5. The connection device according to claim 3, wherein an actuation of said command device causes the rotation of a first internal body of the connection device and a second internal body of the connection device.

6. The connection device according to claim 5, wherein said first internal body is associated with said at least one mechanical element so that said at least one mechanical element rotates together with said first internal body, and wherein said second internal body is associated with said at least one mechanical contact and/or at least one electrical contact so that said at least one mechanical contact rotates together with said second internal body.

7. The connection device according to claim 2, wherein if said pin is completely retracted said at least one mechanical element exits from a side of said casing when said at least one internal body rotates and if said pin is advanced said at least one mechanical element does not exit from a side of said casing when said at least one internal body rotates.

8. The connection device according to claim 1, wherein a translation of said at least one mobile command device causes a movement of one or more internal components of the connection device.

9. The connection device according to claim 8, wherein said at least one mobile command device comprises a slider and a translating rod, and wherein a sliding of said slider causes a translation of said rod.

10. The connection device according to claim 8, comprising a first rotating body and/or a second rotating body, and wherein a sliding of said slider causes a rotation of said first body and/or said second body.

11. The connection device according to claim 8, comprising a mechanism to convert a translation motion into a rotation motion, in particular a rack mechanism.

12. The connection device according to claim 11, comprising a slider, a translating plate and a rotatable body, wherein said plate has at least a shaped slotted hole, wherein said body has at least a pin, wherein said pin is adapted to move in and slide along said slotted hole when said body is mechanically coupled to said plate and when said plate translates.

13. The connection device according to claim 12, wherein said plate has two shaped slotted holes, wherein said body has two pins;

wherein said pins are adapted to move in said slotted holes when said body is mechanically coupled to said plate and when said plate translates.

14. The connection device according to claim 1, comprising an electronic circuitry configured to power-supply at least a lighting device.

15. A lighting device comprising a connection device according to claim 1.

* * * * *